United States Patent [19]

Laws et al.

[11] 4,122,894

[45] Oct. 31, 1978

[54] TUBE MOUNTING MEANS FOR A CERAMIC RECUPERATOR

[75] Inventors: William R. Laws, Worcester Park; David A. Winkworth, Aldershot, both of England

[73] Assignee: British Steel Corporation, London, England

[21] Appl. No.: 767,802

[22] Filed: Feb. 11, 1977

Related U.S. Application Data

[63] Continuation of Ser. No. 574,704, May 5, 1975, abandoned.

[30] Foreign Application Priority Data

May 13, 1974 [GB] United Kingdom ..... 20998/74

[51] Int. Cl.[2] ..... F28F 9/08; F28F 21/04; F16L 5/02

[52] U.S. Cl. ..... 165/76; 165/175; 165/DIG. 8; 285/19; 285/211; 285/343

[58] Field of Search ..... 165/76, 82, 175, 176, 165/178, 173, DIG. 8; 285/19, 332.2, 343, 351, DIG. 12, 211, 212, 187; 277/DIG. 6, 170

[56] References Cited

U.S. PATENT DOCUMENTS

| | | | |
|---|---|---|---|
| 8,411 | 9/1878 | Prindle | 277/48 |
| 641,617 | 1/1900 | Thornycroft | 285/212 |
| 911,156 | 2/1909 | Politz | 285/211 |
| 2,000,653 | 5/1935 | Wilkinson | 285/19 |
| 2,762,611 | 9/1956 | Monroe et al. | 285/212 |
| 3,185,501 | 5/1965 | Bowan et al. | 285/342 |
| 3,610,595 | 10/1971 | Laws et al. | 165/176 |

FOREIGN PATENT DOCUMENTS

| | | | |
|---|---|---|---|
| 1,525,522 | 6/1966 | Fed. Rep. of Germany | 277/DIG. 6 |
| 665,555 | 9/1929 | France | 285/342 |
| 712,991 | 10/1931 | France | 285/211 |

*Primary Examiner*—Carlton R. Croyle
*Assistant Examiner*—Thomas I. Ross
*Attorney, Agent, or Firm*—Bacon & Thomas

[57] ABSTRACT

A recuperator having refractory walls has ceramic recuperator tubes which are located at each of their ends in tapering bores in the recuperator walls. The ends of the tubes are sealed in the bores in the walls by a number of precompressed fibrous refractory rings of different diameter which are in turn held in place and prevented from expanding by refractory locking rings that engage the sidewalls of the bores through a bayonet fitting. Ceramic inserts may be provided in the recuperator walls to form the bores. Buffer rings are provided between the locking rings and the tube ends, and a thrust washer is provided between the fibrous rings and the locking rings.

9 Claims, 2 Drawing Figures

TUBE MOUNTING MEANS FOR A CERAMIC RECUPERATOR

Figure 1:
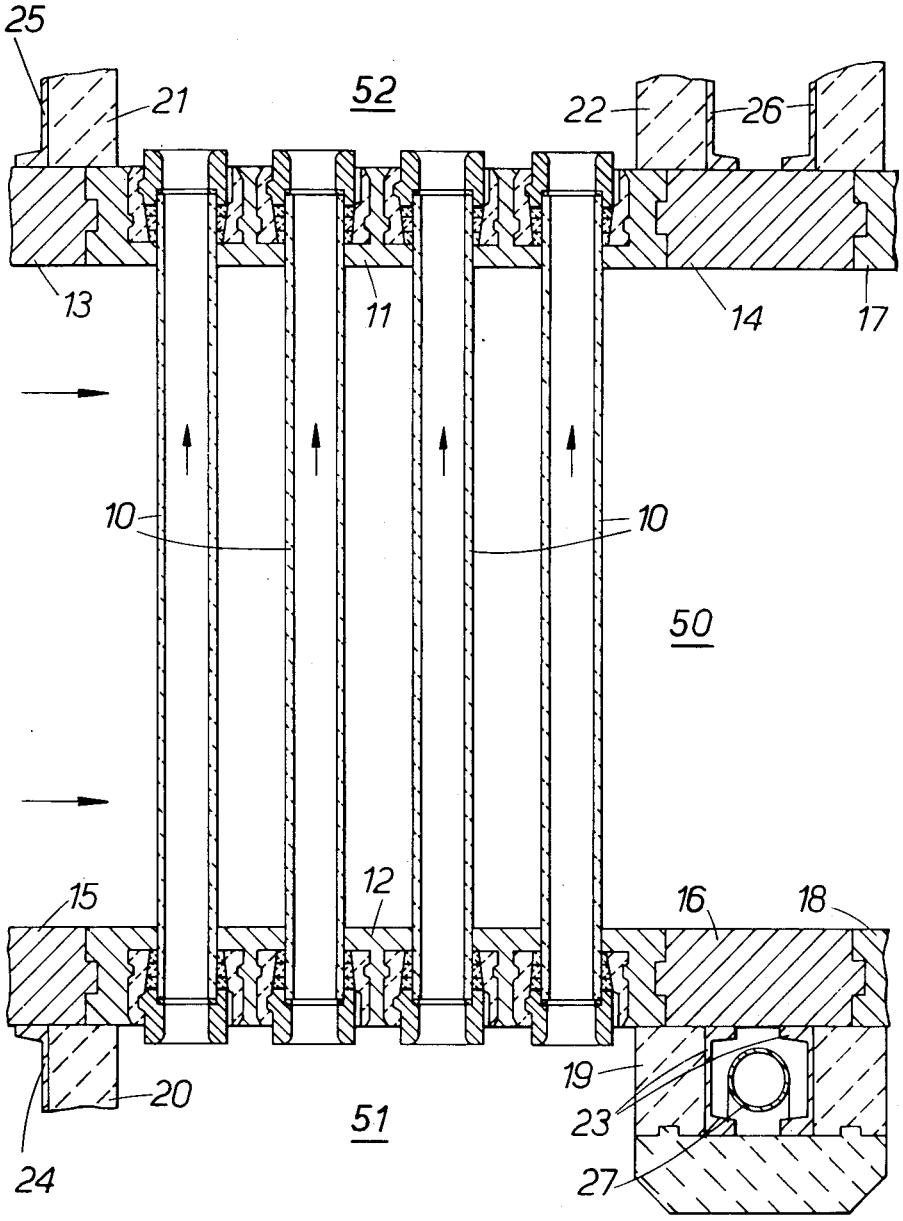

This is a continuation, of application Ser. No. 574,704, filed May 5, 1975, now abandoned.

This invention relates to recuperators, and in particular to recuperators of the type which incorporate ceramic recuperator tubes.

The advantages of recuperators incorporating ceramic recuperator tubes are that they can be used at higher operating temperatures and give generally longer lives than metallic recuperators of similar construction. Their chief disadvantage is that they are prone to high leakage rates which result from the cracking of the ceramic materials and joints under expansion forces. To try and overcome this problem, a recuperator design using flexible seals was developed, and this design is described in U.S. Pat. No. 3,610,595. It consisted basically of ceramic tubes mounted either horizontally or vertically across the waste gas offtakes from a furnace. The tubes were sealed into header boxes which were fitted on the outside of the offtake walls.

The design of the seals between the ceramic tubes and the walls is extremely important since the header boxes and tubes equally carry a relatively high pressure air stream which is subsequently used as combustion air in the furnace. The hot waste gas from the furnace passing through the offtake is a relatively low pressure stream. Thus any defect or improper sealing results in substantial leakage of the high pressure air stream into the low pressure waste gas stream.

It is an object of the present invention to provide an improved recuperator and seal construction which results in minimum leakage from the high pressure stream.

According to one aspect of the present invention a recuperator having refractory walls is provided which includes at least one ceramic tube located at each of its ends in tapering bores in opposite walls of the recuperator, rings that engage the sidewalls of the bores through a bayonet fitting. Ceramic inserts may be provided in the recuperator walls to form the bores. Buffer rings are provided between the locking rings and the tube ends, and a thrust washer is provided between the fibrous rings and the locking rings annular seals extending between the outer circumferential surface of the end of each tube and its corresponding bore, the seals comprising a plurality of separate rings of progressively greater overall diameter made from fibrous referactory material the bores tapering outwardly towards the tube ends, and means adapted to be held in place by engagement with the sidewall of the bore for preventing the sealing rings around the tube in precompressed condition in a direction parallel to the tube.

The means to maintain the rings in a compressed state preferably is formed in a single piece wholly from ceramic material.

The recuperator walls may include ceramic inserts, and the tapering holes may be provided in the ceramic inserts.

The means for maintaining the sealing rings in a compressed state preferably comprises ceramic locking rings which cooperate with the refractory recuperator wall by means of bayonet fittings within the respective bores. A buffer ring may be provided between each locking ring and the end of the tube. A thrust washer may be positioned between the compressed sealing rings and the means for maintaining the rings in a compressed state, to minimise any abrasive action on the rings themselves.

Figure 2:
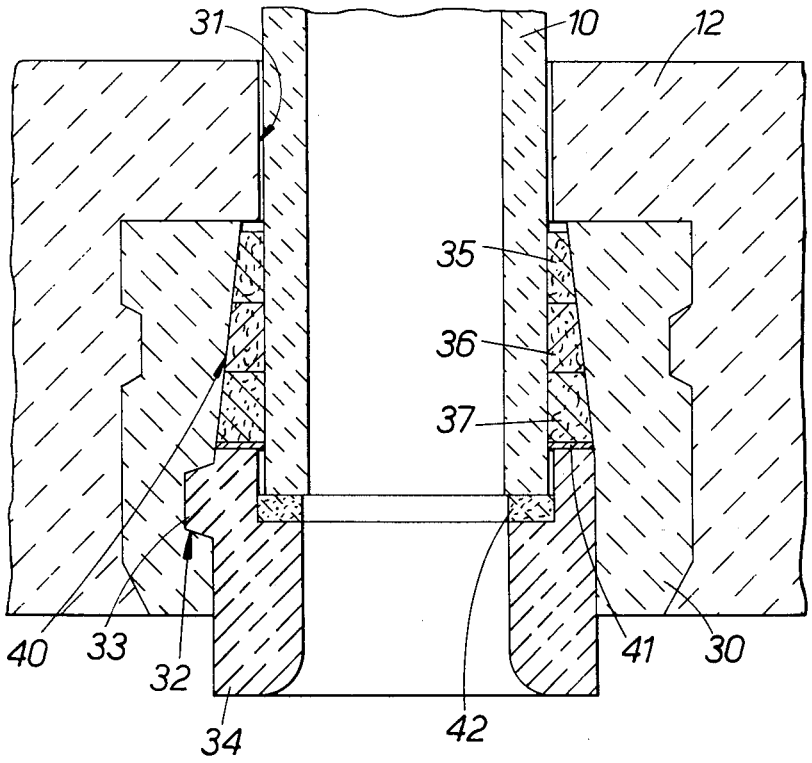

In the accompanying drawings,

FIG. 1 shows a plan view in section of part of a recuperator being one embodiment of the present invention, and FIG. 2 shows in detail the construction of the recuperator at an end of one of the recuperator tubes.

A number of parallel ceramic tubes 10 are mounted across the duct 50 which carries hot waste gases from a furnace (not shown). The tubes 11 are located at their ends in respective monolithic refractory blocks 11 and 12. Each block 11 and 12 forms a section of the continuous wall of the duct 50, adjacent refractory sections to block 11 being identified as 13 and 14, and adjacent refractory sections to block 12 being identified as 15 and 16 respectively. A further pair of opposed monolithic blocks positioned further along the duct can be seen partly at 17 and 18, adjacent sections 14 and 16 respectively. A further set of tubes 10 extend between monolithic blocks 17 and 18 but these are not shown. The joints between abutting sections of the wall of the duct 50 have tongues and grooves which assist in location of sections of the wall and also minimise leakage into the duct 50. Each abutting joint is overlapped on the outside of the wall by either a refractory block 19, such as that overlapping the joint between block 12 and section 16, or by the end of a refractory wall 20 such as that shown overlapping the joint between block 12 and section 15. The joint between block 11 and section 13 is similarly overlapped by the end of a refractory wall 21 and the joint between block 11 and section 14 by the end of a refractory wall 22.

The tubes 10 are made of silicon carbide which is a heat-conducting ceramic material. Air to be heated in the recuperator is passed through the tubes 10 thereby enabling heat from the waste gas in duct 50 to be transmitted to the air. There are eight tubes 10 in two rows of four located in holes in the pair of opposite wall blocks 11 and 12. There are four pairs of similar wall blocks positioned vertically above one another, so that there are in total thirty-two tubes in any one pass of the recuperator.

The refractory wall 20 forms part of the wall of a header box 51 which serves to take the air from a previous set of tubes located between blocks 17 and 18 in which the air has already been heated, and supply it to the set of tubes 10 located between blocks 11 and 12.

The refractory walls 21 and 22 defined a second header box 52 which serves to collect heated air leaving the tubes 10. The air in the tubes is under pressure and flows in the direction shown by the arrows marked within the tubes 10 in FIG. 1. The second header box 52 is connected to an outlet (not shown) which conducts the hot air to the process plant in which it is to be used.

Referring to FIG. 2 which is a detail of FIG. 1, each tube 10 is located at its ends in a bore or hole 31 in the monolithic refractory block 12. The block 12 has an annular insert 30 of ceramic material which extends only partly through block 12. Insert 30 has a recess 32 on its inner face which cooperatively engages a protrusion 33 on an annular single-piece ceramic locking ring 34 in the manner of a conventional bayonet fitting.

The inner surface of annular insert 30 has a tapering bore 40, which surrounds the outer circumferential surface of the end of tube 10. Three annular packing rings 35, 36, and 37 are located between the outer circumferential surface of the end of tube 10 and the tapering bore 40. The overall diameter of each of the rings is different, the diameter increasing from ring 35 to ring 37. The rings are made of a compressible fibrous refractory material such as alumino-silicate ceramic fibre which is both flexible and leak proof when compressed. The locking ring 34 acts to hold the rings in the compressed state, when they have been packed into position, that is after they have been compressed in the bore 40. A thrust washer 41 between the locking precompressed scaling ring 34 and ring 37 prevents damage by abrasion to the ring 37 when the locking ring 34 is being inserted and twisted into the bayonet fitting provided by recess 32 and protrusion 33.

The thrust washer 41 is made of a wear-resistant material. Between the locking ring 34 and the end of tube 10, a buffer ring 42 is provided, and this prevents any damage to either the tube 10 or the locking ring 34 which might arise if they were permitted to strike one another when the tube expands.

It is also possible for the above features relating to insert 30 to be obtained by casting the relevant shapes straight into the wall block 11, 12, etc. whereby the bore 40 is formed directly in the wall, along with the female bayonet fitting.

It is believed that much of the improved sealing provided by the invention arises from the precompression of the rings so that their overall diameter is increased and their internal diameter is reduced so that a tight grip is obtained both on the tube and the block at the time of installation of the sealing rings.

The invention permits a ceramic-to-ceramic bayonet joint, which is inherently unable to withstand severe stresses, to be used because the sealing rings must only be prevented from expanding. The bayonet fitting does not need to physically react forces required to compress the seals, which may be quite appreciable. A problem of sealing refractory tube ends in a refractory recuperator has therefor been solved by the instant invention.

We claim:

1. A recuperator including refractory walls, at least one horizontal ceramic tube located at each of its ends in tapered bores in opposite vertical refractory walls of the recuperator, such bores having sidewalls which have their minimum diameters located away from the ends of the tube, a plurality of annular seals extending between the outer circumferential surface of the end portion of each tube and the corresponding bore, each seal being comprised of a plurality of separate rings having outside diameters that are progressively larger in diameter towards the ends of the tube and being formed of fibrous refractory material, said rings being in individually precompressed condition between the respective sidewall of the bore and the tube circumferential surface, and means held in place by engagement with each recuperator wall for preventing the precompressed rings from expanding in a direction parallel to each tube to thereby maintain the rings in precompressed condition between each bore sidewall and adjacent tube circumferential surface, said means for preventing the precompressed rings from expanding being formed in a single piece wholly from ceramic material.

2. A recuperator according to claim 1 which the recuperator walls included ceramic inserts, the tapered bores being provided in the said inserts.

3. A recuperator according to claim 2 in which each of the means for preventing the precompressed rings from expanding has a locking ring which cooperates with the inner sidewall of the bore in the respective ceramic insert by means of a bayonet fitting.

4. A recuperator according to claim 1 in which the means for preventing the precompressed rings from expanding has a locking ring which cooperates with the recuperator wall by means of a bayonet fitting having one part located on the sidewall of the bore.

5. A recuperator according to claim 4 in which the means for preventing the precompressed rings from expanding and the said locking rings are integrally formed wholly from ceramic material, whereby said bayonet fitting comprises a ceramic to ceramic connection.

6. A recuperator according to claim 4 including a buffer ring between the locking ring and the end of the tube.

7. A recuperator according to claim 1 including a thrust washer positioned between the compressed rings and the means for preventing the precompressed rings from expanding.

8. A recuperator according to claim 1 in which the outer wall of the ceramic tube at each end thereof is spaced from the sidewall of the respective tapered bore in the refractory walls and the ends of the ceramic tube beyond the outermost annular seal at each end of the tube, the means for preventing the precompressed rings from expanding being spaced from said ceramic tube, a buffer ring being interposed between each end of the ceramic tube and the corresponding means for preventing the precompressed rings from expanding.

9. A recuperator according to claim 8 in which a thrust washer is positioned between the outermost precompressed ring and the means for preventing the precompressed rings at each end of the tube from expanding.

* * * * *